US012077929B2

(12) United States Patent
Fujimoto et al.

(10) Patent No.: US 12,077,929 B2
(45) Date of Patent: Sep. 3, 2024

(54) REINFORCEMENT METHOD AND REINFORCEMENT STRUCTURE OF A MANHOLE

(71) Applicant: NIPPON TELEGRAPH AND TELEPHONE CORPORATION, Tokyo (JP)

(72) Inventors: Norihiro Fujimoto, Tokyo (JP); Tomoyasu Nagai, Tokyo (JP); Shunsuke Tsuda, Tokyo (JP); Takashi Sugiura, Tokyo (JP)

(73) Assignee: NIPPON TELEGRAPH AND TELEPHONE CORPORATION, Tokyo (JP)

( * ) Notice: Subject to any disclaimer, the term of this patent is extended or adjusted under 35 U.S.C. 154(b) by 981 days.

(21) Appl. No.: 17/047,641

(22) PCT Filed: Mar. 26, 2019

(86) PCT No.: PCT/JP2019/012769
§ 371 (c)(1),
(2) Date: Oct. 14, 2020

(87) PCT Pub. No.: WO2019/202925
PCT Pub. Date: Oct. 24, 2019

(65) Prior Publication Data

US 2021/0148079 A1 May 20, 2021

(30) Foreign Application Priority Data

Apr. 16, 2018 (JP) ..... 2018-078732

(51) Int. Cl.
*E02D 29/12* (2006.01)

(52) U.S. Cl.
CPC .... *E02D 29/121* (2013.01); *E02D 2200/1642* (2013.01)

(58) Field of Classification Search
CPC ..... E02D 29/121; E02D 2200/1642; E02D 29/12
See application file for complete search history.

(56) References Cited

FOREIGN PATENT DOCUMENTS

CN 113668612 A * 11/2021 ..... E02D 29/12
JP 20082175 A 1/2008
(Continued)

OTHER PUBLICATIONS

Manhole Handhole for Communication, Mar. 26, 2018, reading day, Sunrec Co., LTD, http://www.sunrec.co.jp/products_detail02/.
(Continued)

*Primary Examiner* — Babajide A Demuren

(57) ABSTRACT

Provided are a reinforcing method and a reinforcing structure for a manhole having a neck part in a position shifted from the middle part of an upper slab which allow the buried manhole to be reinforced sufficiently against stress inflicted thereon while reducing the operation and material costs involved in the reinforcement. The manhole reinforcing method according to the invention is a method for reinforcing a manhole including a rectangular trunk part having an upper slab, a sidewall, and a lower slab and a neck part provided in a position shifted from a middle part of the upper slab of the trunk part, the method includes providing a strip-shaped reinforcing member of reinforced fiber at the upper slab and the lower slab while refraining from providing the strip-shaped reinforcing member at the sidewall, and fixing an upper part of the sidewall and the upper slab and a lower part of the sidewall and the lower slab each by a reinforcing member at the middle part of the sidewall in the longitudinal direction of the trunk part.

20 Claims, 12 Drawing Sheets

(56) References Cited

FOREIGN PATENT DOCUMENTS

| | | | |
|---|---|---|---|
| JP | 4264095 | B2 | 2/2009 |
| JP | 2012229562 | A | 11/2012 |
| JP | 5377563 | B2 | 10/2013 |

OTHER PUBLICATIONS

Category of lid (T-25, T-14) and basis of design), Japan Ground Manhold Association, Mar. 26, 2018, reading day.

* cited by examiner

REINFORCEMENT METHOD AND REINFORCEMENT STRUCTURE OF A MANHOLE

CROSS-REFERENCE TO RELATED APPLICATIONS

This application is a U.S. 371 Application of International Patent Application No. PCT/JP2019/012769, filed on 26 Mar. 2019, which application claims priority to and the benefit of JP Application No. 2018-078732, filed on 16 Apr. 2018, the disclosures of which are hereby incorporated herein by reference in their entireties.

TECHNICAL FIELD

The present invention relates to a manhole reinforcing method and a manhole reinforcing structure, and particularly to a reinforcing method and a reinforcing structure for a manhole having a neck part provided in a shifted position from the center part of an upper slab.

BACKGROUND ART

Facilities exposed to the external environment degrade over time. Manholes which are concrete structures buried underground are no exception. Therefore, there has been a demand for manhole reinforcing techniques.

PTL 1 discloses a manhole including a body having a lower slab, a side wall, and an upper slab and a neck part as an opening connected to the upper slab, trapezoidal hunch blocks are arranged horizontally at a corner part including four corners of the sidewall, and strip-shaped reinforcing members of fiber-reinforced plastic are adhered to the inner surfaces of the lower slab, the sidewall, and the upper slab.

According to the disclosure of PTL 2, the upper part of a sidewall and an upper slab and the lower part of the sidewall and a lower slab are fixed by reinforcing members in the longitudinal center of the sidewall of a rectangular manhole.

CITATION LIST

Patent Literature

[PTL 1] Japanese Patent No. 4264095 [PTL 2] Japanese Patent No. 5377563

Non Patent Literature

[NPL 1] SUNREC CO., LTD., "Tsushin-you Man-holu/hando-holu" (Manholes/hand holes for communication) [online], [retrieved Mar. 26, 2018], retrieved from the Internet: <URL: http://www.sunrec.co.jp/products_detail02/>

[NPL 2] JAPAN GROUND MANHOLE ASSOCIATION, "Futa no Shurui (T-25, T-14) no Shiyou Kubun oyobi Sekkei Konkyo" (Use classification and reasons for designs of types of covers) (T-25, T-14) [online], [retrieved Mar. 26, 2018], retrieved from the Internet: <URL: http://jgma.gr.jp/manhole/shurui/>

SUMMARY OF THE INVENTION

Technical Problem

Using the techniques disclosed in PTL 1 and PTL 2 as a manhole reinforcing method, some reinforcement effects may probably be obtained. However, the inventors have found as a result of study that when a manhole made of a different material and having a different wall thickness such as a resin manhole is buried underground, the sidewall is subjected to stress directed from the inside to the outside because of a load from the upper part of the body. Simply combining these techniques does not provide sufficient reinforcement against the stress directed from the inside to the outside. In particular, there has been a demand for reduction in the operation and material costs involved in reinforcement of manholes. From this point of view, there was still room for further improvement in the reinforcement of manholes.

Furthermore, the manholes disclosed in PTL 1 and PTL 2 have a rectangular parallelepiped such as a box shape and a rectangular shape. The neck part of the manhole each disclosed in PTL 1 and PTL 2 is located in the center of the upper slab. In such a manhole, strain is generated uniformly on the upper slab and local strain is not generated.

In contrast, when a manhole has a neck part in a position shifted from the middle part of the upper slab, the distance from the outer edge of the upper slab to the opening of the upper slab continuous with the neck part greatly varies depending on the location. As a result of intensive study, the inventors have found that when a manhole has a neck part in a position shifted from the middle part of the upper slab, local strain increases and cracks are easily generated in a location where the distance from the outer edge of the upper slab to the opening is long.

In view of the foregoing, it is an object of the present invention to provide a reinforcing method and a reinforcing structure for a manhole having a neck part positioned shifted from the center part of the upper slab which allow the buried manhole to be reinforced sufficiently against stress inflicted thereon while reducing the operation and material costs involved in the reinforcement.

Means for Solving the Problem

A method for reinforcing a manhole according to a first aspect of the invention is a method for reinforcing a manhole including a rectangular trunk part having an upper slab, a sidewall, and a lower slab and a neck part provided in a position shifted from a middle part of the upper slab of the trunk part, and the method includes providing a strip-shaped reinforcing member of reinforced fiber at the upper slab and the lower slab while refraining from providing the strip-shaped reinforcing member at the sidewall, and fixing an upper part of the sidewall and the upper slab and a lower part of the sidewall and the lower slab each by a reinforcing member at a middle part of the sidewall in a longitudinal direction of the trunk part.

According to one embodiment of the invention, the strip-shaped reinforcing member provided at the upper slab has a smaller area than the strip-shaped reinforcing member provided at the lower slab.

According to one embodiment of the invention, the neck part has a center position shifted to one end side from a middle position of the trunk part in the longitudinal direction, the strip-shaped reinforcing member provided at the upper slab has a greater area on the other end side in the longitudinal direction with respect to the neck part than on the one end side in the longitudinal direction with respect to the neck part.

According to one embodiment of the invention, the strip-shaped reinforcing member at the upper slab is provided in an in-plane direction of the upper slab and in a direction orthogonal to the longitudinal direction.

A reinforcing structure for a manhole according to a second aspect of the invention is a structure for reinforcing a manhole including a rectangular trunk part having an upper slab, a sidewall, and a lower slab and a neck part provided in a position shifted from a middle part of the upper slab of the trunk part, and the structure includes a strip-shaped reinforcing member of reinforced fiber provided at the upper slab part and the lower slab part and refrained from being provided at the sidewall, and a reinforcing member each fixing an upper part of the sidewall and the upper slab and a lower part of the sidewall and the lower slab at a middle part of the sidewall in a longitudinal direction of the trunk part.

According to one embodiment of the invention, the strip-shaped reinforcing member provided at the upper slab has a smaller area than the strip-shaped reinforcing member provided at the lower slab.

According to one embodiment of the invention, the neck part has a center position shifted to one end side from a middle position of the trunk part in the longitudinal direction, and the strip-shaped reinforcing member provided at the upper slab has a greater area on the other end side in the longitudinal direction with respect to the neck part than on the one end side in the longitudinal direction with respect to the neck part.

According to one embodiment of the invention, the strip-shaped reinforcing member at the upper slab is provided in an in-plane direction of the upper slab and in a direction orthogonal to the longitudinal direction.

Effects of the Invention

According to the present invention, a reinforcing method and a reinforcing structure for a manhole having a neck part provided in a shifted position from the middle part of an upper slab can be provided, and the method and the structure allow the buried manhole to be sufficiently reinforced against stress inflicted thereon while reducing the operation and material costs involved in the reinforcement.

DESCRIPTION OF EMBODIMENTS

Figure 1:
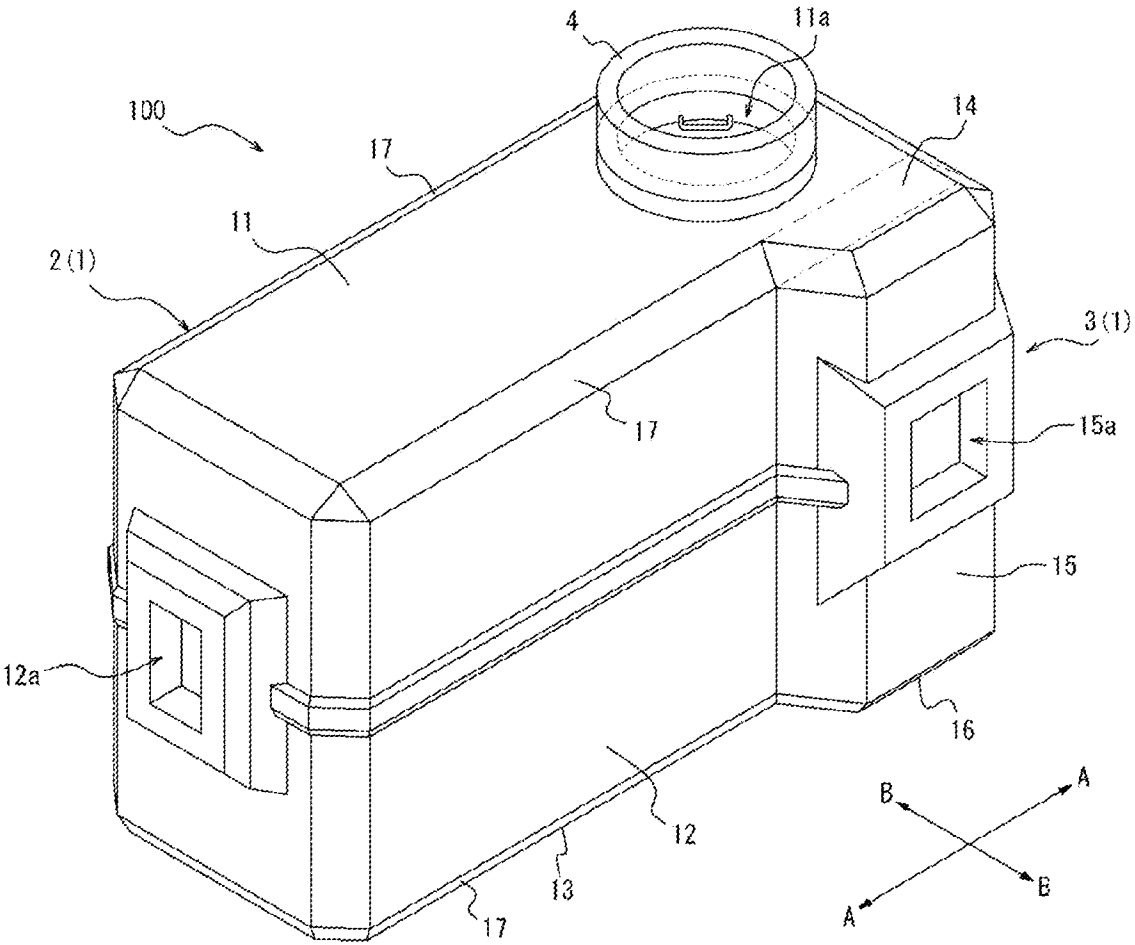
FIG. 1 is a perspective view of a reinforcing structure for a manhole according to one embodiment of the present invention.

Hereinafter, a manhole reinforcing method and a manhole reinforcing structure according to the present invention will be described with reference to FIGS. 1 to 11. Members and parts common among the drawings are designated by the same reference characters.

FIG. 1 is a perspective view of a reinforcing structure 100 for a manhole 1 according to the present embodiment. More specifically, the manhole 1 according to the present embodiment is an L-type manhole. The manhole 1 is an assembled resin manhole produced by kneading a thermosetting resin (fluid resin) such as an unsaturated polyester resin instead of cement with aggregate and a filler to obtain resin concrete and integrally molding the resin concrete with a reinforcing material such as reinforcing steel or glass fiber.

As shown in FIG. 1, the manhole 1 includes a trunk part 2, a protrusion 3, and a neck part 4.

The trunk part 2 is a rectangular body. More specifically, the rectangular trunk part 2 includes an upper slab 11, a sidewall 12, and a lower slab 13. The protrusion 3 according to the present embodiment is provided to protrude from the sidewall 12 of the trunk part 2. In this way, the manhole 1 according to the present embodiment has an L-shape formed by the trunk part 2 and the protrusion 3.

The protrusion 3 according to the present embodiment is also formed to have a substantially rectangular shape and includes a protrusion upper slab 14, a protrusion sidewall 15, and a protrusion lower slab 16. According to the present embodiment, the upper slab 11 of the trunk part 2 and the protrusion upper slab 14 of the protrusion 3 are made of an integrally formed L-shaped slab. According to the present embodiment, the lower slab 13 of the trunk part 2 and the protrusion lower slab 16 of the protrusion 3 are made of an integrally formed L-shaped slab. The protrusion sidewall 15 is provided with an opening 15*a* through which a communication cable or the like can be extended in and out of the protrusion 3.

The upper slab 11 and the lower slab 13 of the trunk part 2 have a rectangular plate shape. The sidewall 12 of the trunk part 2 has a rectangular tube shape which connects the upper slab 11 and the lower slab 13.

An opening 11*a* connected with the neck part 4 is formed at the upper slab 11 of the trunk part 2. The manhole 1 buried underground can be entered/exited to/from the trunk part 2 through the neck part 4 and the opening 11*a* from the upper end of the neck part 4 positioned on the ground. As shown in FIG. 1, the opening 11*a* is formed shifted from the middle part of the upper slab 11 of the trunk part 2. In other words, the opening 11*a* according to the present embodiment is formed to have its center position shifted from the center position of the upper slab 11. More specifically, the opening 11*a* according to the present embodiment is formed in a position localized to one end side from the middle position of the upper slab 11 in the longitudinal direction A of the trunk part 2. The center position of the upper slab 11 according to the present embodiment refers to the position where the diagonal lines of the rectangular upper slab 11 of the trunk part 2 cross each other.

The lower slab 13 of the trunk part 2 is provided with a basin 13*a* (see FIG. 2) for example for drainage. The position and size of the basin 13*a* are not particularly limited and may be changed as appropriate. The sidewall 12 of the trunk part 2 is provided with an opening 12*a* through which a communication cable or the like can be extended in or out of the trunk part 2.

The neck part 4 is provided in a shifted position from the middle part of the upper slab 11 of the trunk part 2. More specifically, the neck part 4 is provided to project upwardly from the position of the opening 11*a* of the upper slab 11. Therefore, similarly to the opening 11*a*, the neck part 4 according to the present embodiment is provided in such a position that its center position does not match the center position of the upper slab 11. More specifically, the neck part 4 according to the present embodiment is localized on one end side rather than the middle position of the upper slab 11 in the longitudinal direction A of the trunk part 2.

The manhole 1 according to the present embodiment may be an L-shaped manhole such as "L-3R type (W1600×L2500×H1500)" manufactured by SUNREC CO., LTD. disclosed in NPL 1 but the manhole is not particularly limited if the manhole has a neck part provided in a shifted position from the middle part of the upper slab of the rectangular trunk part.

Figure 2:
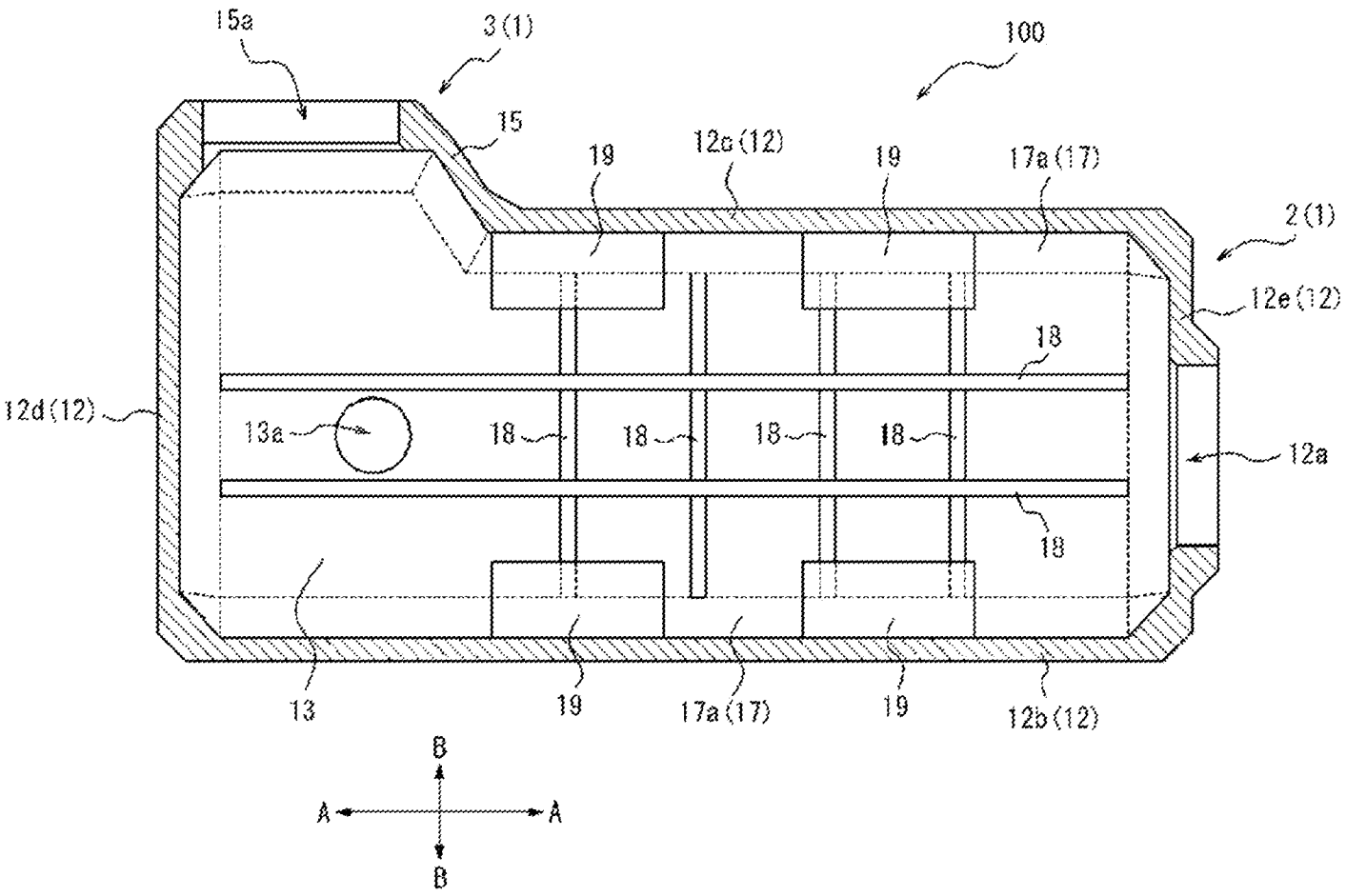
FIG. 2 is a sectional view of the reinforcing structure in FIG. 1 taken horizontally, showing the lower slab from the side of the upper slab.
Figure 3:
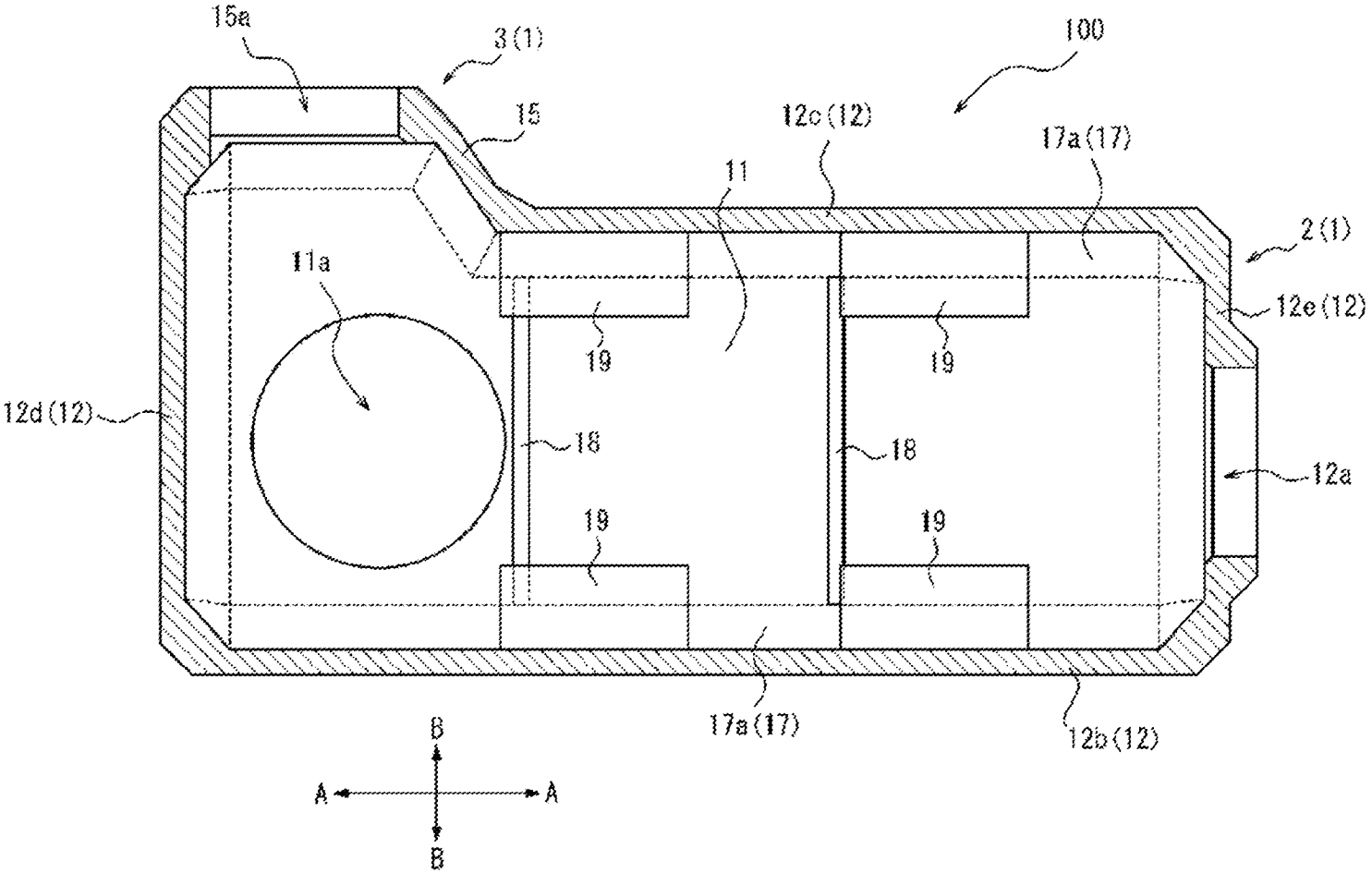
FIG. 3 is a sectional view of the reinforcing structure in FIG. 1 taken horizontally, showing the upper slab from the side of the lower slab.
Figure 4:
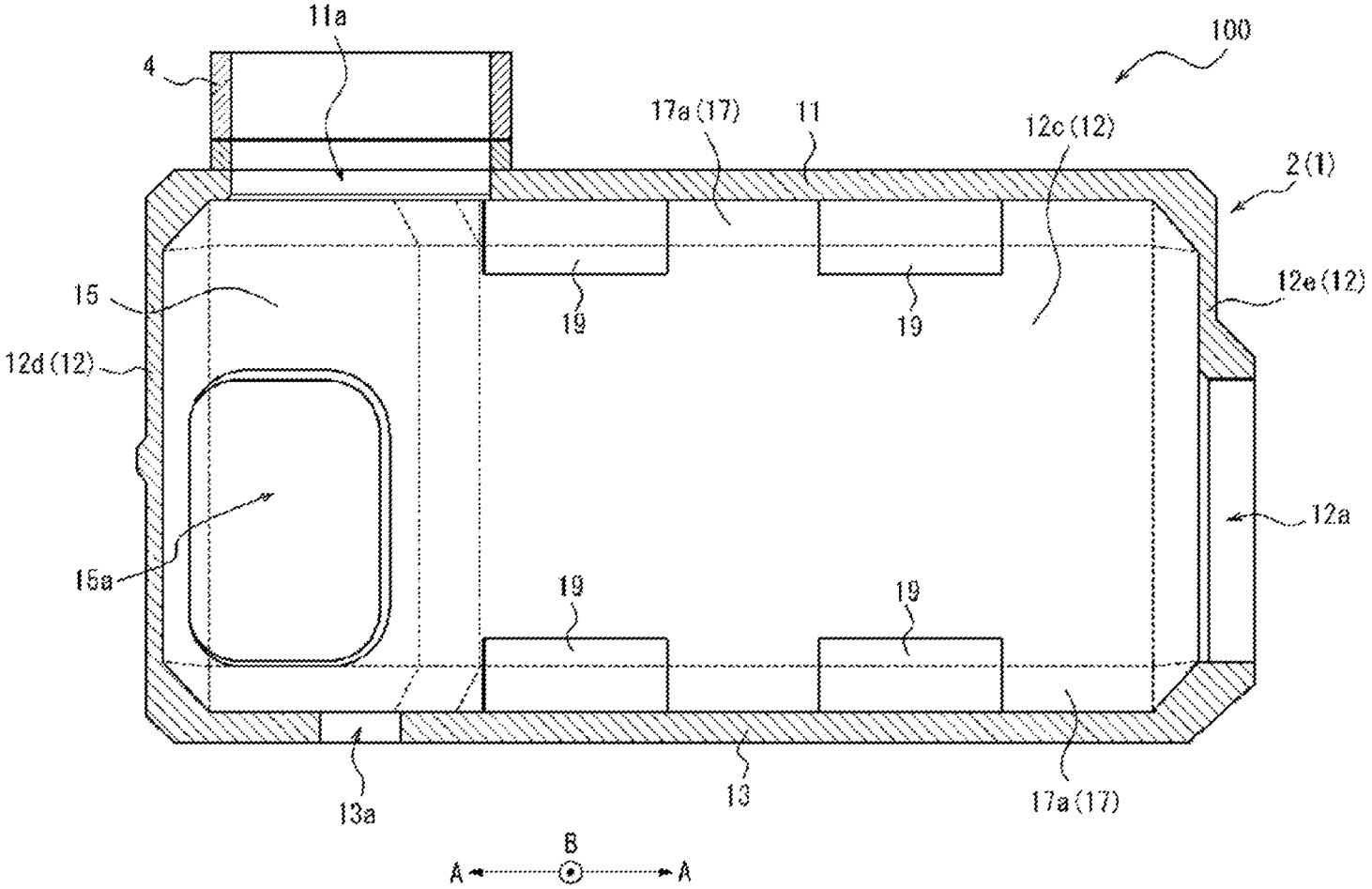
FIG. 4 is a sectional view of the reinforcing structure in FIG. 1 taken vertically.

FIG. 2 is a sectional view of the reinforcing structure 100 for the manhole 1 shown in FIG. 1 taken in the horizontal direction, showing the lower slab 13 as viewed from the side of the upper slab 11. FIG. 3 is a sectional view of the reinforcing structure 100 for the manhole 1 shown in FIG. 1 taken in the horizontal direction, showing the upper slab 11 as viewed from the side of the lower slab 13. FIG. 4 is a sectional view of the reinforcing structure 100 of the manhole 1 shown in FIG. 1 taken in the vertical direction.

As shown in FIGS. 2 to 4, the reinforcing structure 100 for the manhole 1 includes strip-shaped reinforcing members 18 and reinforcing members 19. The strip-shaped reinforcing members 18 and the reinforcing members 19 are provided inside manhole 1.

The strip-shaped reinforcing members 18 are strip-shaped (sheet-shaped) members made of reinforced fiber. As shown in FIG. 2, the strip-shaped reinforcing members 18 are adhered to the inner surface of the lower slab 13 of the manhole 1 by an adhesive resin. As shown in FIG. 3, the strip-shaped reinforcing members 18 are adhered to the inner surface of the upper slab 11 of the manhole 1 by an adhesive resin. As shown in FIG. 4, the strip-shaped reinforcing members 18 made of reinforced fiber are not provided on the sidewall 12 and are provided on the upper slab 11 and the lower slab 13. More specifically, the strip-shaped reinforcing members 18 according to the present embodiment are provided only at the upper slab 11 and the lower slab 13. Various kinds of members may be used for the strip-shaped reinforcing members 18, examples of which include a fiber reinforced plastic member and a carbon fiber member.

As shown in FIGS. 2 and 3, according to the present embodiment, the area of the strip-shaped reinforcing members 18 provided at the upper slab 11 is smaller than the area of the strip-shaped reinforcing members 18 provided at the lower slab 13. More specifically, the number of strip-shaped reinforcing members 18 adhered to the upper slab 11 according to the present embodiment is smaller than the number of strip-shaped reinforcing members 18 adhered to the lower slab 13. Effects of the arrangement will be described below in more detail.

As described above, the center position of the neck part 4 is provided in a shifted position on one end side (the left side in FIG. 3) from the middle position of the trunk part 2 in the longitudinal direction A. Therefore, according to the present embodiment, among the strip-shaped reinforcing members 18 provided at the upper slab 11, the area of those provided on the other end side with respect to the neck part 4 (the right side in FIG. 3) in the longitudinal direction A is greater than the area of those provided on one end side with respect to the neck part 4 (the left side in FIG. 3) in the longitudinal direction A. More specifically, according to the present embodiment, the strip-shaped reinforcing members 18 are not provided on one end side with respect to the neck part 4 (the left side in FIG. 3) in the longitudinal direction A, and the strip-shaped reinforcing members 18 are provided only on the other end side with respect to the neck part 4 (the right side in FIG. 3) in the longitudinal direction A. Effects of the arrangement will also described below in more detail.

According to the present embodiment, the strip-shaped reinforcing members 18 at the upper slab 11 are provided in the in-plane direction of the upper slab 11 and orthogonal to the longitudinal direction A (hereinafter simply referred to as "the transverse direction B"). The strip-shaped reinforcing members 18 at the upper slab 11 are also provided entirely in the transverse direction B of the upper slab 11. Note that the whole area in the transverse direction B of the upper slab 11 according to the present embodiment refers to the entire area of the part sandwiched between slope parts 17*a* (which will be described) in the transverse direction B. Effects of the arrangement by the arrangement will be described below in more detail.

The reinforcing members 19 fix the upper part of the sidewall 12 and the upper slab 11 and the lower part of the sidewall 12 and the lower slab 13 at the middle part of the sidewall 12 in the longitudinal direction A. More specifically, for example as illustrated in FIG. 2, the sidewall 12 according to the present embodiment includes longitudinal sidewall parts 12*b* and 12*c* in the longitudinal direction A and the transverse sidewall parts 12*d* and 12*e* in the transverse direction B. The reinforcing members 19 according to the present embodiment fix the upper parts of the longitudinal sidewall parts 12*b* and 12*c* and the upper slab 11 and the lower parts of the longitudinal sidewall parts 12*b* and 12*c* and the lower slab 13 at the middle parts of the longitudinal sidewall parts 12*b* and 12*c* in the longitudinal direction A.

The reinforcing members 19 which fix the upper slab 11 and the sidewall 12 are provided to be in contact with the region from the upper part of the sidewall 12 to the upper slab 11 via a corner part 17 at which the sidewall 12 and the upper slab 11 cross each other. The reinforcing members 19 which fix the lower slab 13 and the sidewall 12 are provided to be in contact with the region from the lower part of the sidewall 12 to the lower slab 13 via the corner part 17 at which the sidewall 12 and the lower slab 13 cross each other. The reinforcing member 19 may be fixed, for example, by using an anchor bolt pre-installed in the wall of the trunk part 2.

Note that the shape of the reinforcing member 19 is not particularly limited if the member can fix the upper part of the sidewall 12 and the upper slab 11 and the lower part of the sidewall 12 and the lower slab 13.

Next, a method for reinforcing the manhole 1 according to the present embodiment will be described.

First, the strip-shaped reinforcing members 18 are adhered to the upper slab 11 and the lower slab 13 of the manhole 1. As described above, according to the present embodiment, the strip-shaped reinforcing members 18 are not provided at the sidewall 12 and are provided at the upper slab 11 and the lower slab 13. More specifically, the strip-shaped reinforcing members 18 according to the present embodiment are provided only at the upper slab 11 and the lower slab 13.

Then, the upper part of the sidewall 12 and the upper slab 11 and the lower part of the sidewall 12 and the lower slab 13 are fixed by the reinforcing members 19 at the middle part of the sidewall 12 of manhole 1 in the longitudinal direction A. Note that at the corner part 17 where the sidewall 12 and the upper slab 11 cross each other, a slope part 17*a* inclined at a prescribed angle (for example 45°) with respect to the sidewall 12 and the upper slab 11 is provided. The inner surface of the sidewall 12 is connected to one end of the slope part 17*a*, and the inner surface of the upper slab 11 is connected to the other end of the slope part 17*a*. Similarly, a slope part 17*a* is provided at the corner part 17 between the sidewall 12 and the lower slab 13. The reinforcing members 19 provided to fix the upper part of the sidewall 12 and the upper slab 11 are in contact with the upper part of the inner surface of the sidewall 12, the slope part 17*a* between the sidewall 12 and the upper slab 11, and the inner surface of the upper slab 11. The reinforcing members 19 provided to fix the lower part of the sidewall 12 and the lower slab 13 are in contact the lower part of the inner surface of the sidewall 12, the slope part 17*a* between the sidewall 12 and the lower slab 13, and the inner surface of the lower slab 13.

Note that the middle part of the sidewall 12 of the manhole 1 in the longitudinal direction A refers not only to the middle position in the longitudinal direction A where the tensile stress inside the trunk part 2 is maximized but also to the middle region in the longitudinal direction A where tensile stress to the inside of the trunk part 2 is generated. As shown in FIGS. 2 to 4, the reinforcing member 19 according to the present embodiment is not provided in the middle position of the sidewall 12 in the longitudinal direction A and is provided on each side of the middle position in the longitudinal direction A to sandwich the middle position therebetween, while the reinforcing members 19 may be provided for example in a range which includes the middle position of the sidewall 12 in the longitudinal direction A.

According to the present embodiment, the area of the strip-shaped reinforcing members 18 provided at the upper slab 11 is smaller than the area of the strip-shaped reinforcing members 18 provided at the lower slab 13. More specifically, the upper slab 11 according to the present embodiment is adhered with a smaller number of strip-shaped reinforcing members 18 than those adhered to the lower slab 13. Effects of the arrangement will be described below in more detail.

According to the present embodiment, the strip-shaped reinforcing members 18 at the upper slab 11 are provided so that the area for providing the members on the other end side (the right side in FIG. 3) in the longitudinal direction A with respect to the neck part 4 is larger than the area for providing the members on one end side (the left side in FIG. 3) in the longitudinal direction A with respect to the neck part 4. Effects of the arrangement will also be described below in more detail.

According to the present embodiment, the strip-shaped reinforcing members 18 at the upper slab 11 are provided in the transverse direction B. More specifically, the strip-shaped reinforcing members 18 at the upper slab 11 are provided entirely along the upper slab 11 in the transverse direction B. Effects of the arrangement will be described below in more detail.

Next, effects of reinforcement using the reinforcing structure 100 for the manhole 1 according to the present embodiment will be described.

First, among the components of the reinforcing structure 100 for the manhole 1 according to the present embodiment, effects of reinforcement using the strip-shaped reinforcing members 18 provided at the lower slab 13 and the reinforcing members 19 provided to fix the upper part of the sidewall 12 and the upper slab 11 and the lower part of the sidewall 12 and the lower slab 13 at the middle part of the sidewall 12 in the longitudinal direction A will be described.

Figure 5A:
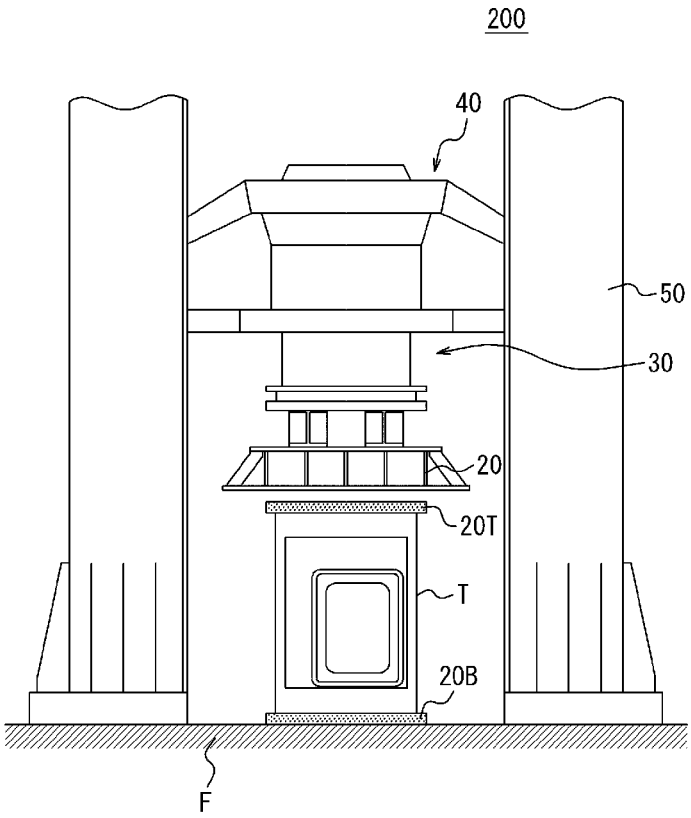
FIG. 5A is a front view of the structure of a structure testing device.
Figure 5B:
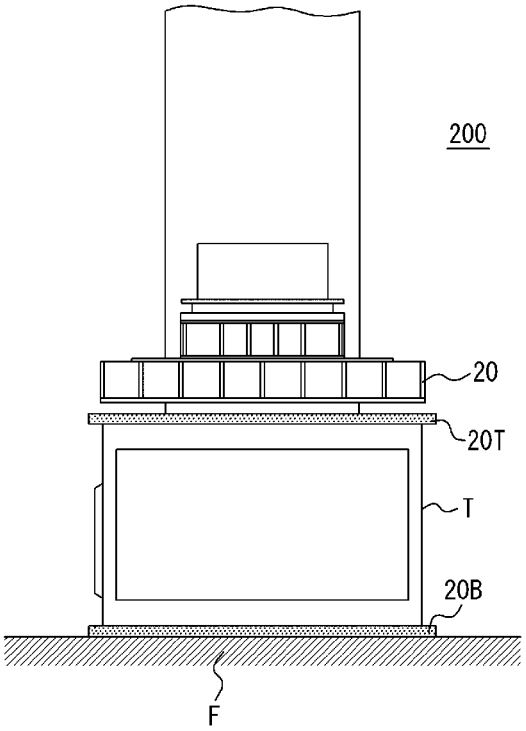
FIG. 5B is a right side view of the structure of the structure testing device.

In order to determine the effects of reinforcement using the strip-shaped reinforcing members 18 provided at the lower slab 13 and the reinforcing members 19 provided in the above-described position, the inventors conducted a load test and the upper part of the reinforced body was loaded. First, with reference to FIGS. 5A and 5B, the structure of a structure tester 200 for the load test will be described. FIG. 5A is a front view of the structure of the structure tester 200. FIG. 5B is a right side view of the structure of the structure tester 200.

As shown in FIGS. 5A and 5B, the structure tester 200 includes a loading plate 20 made of a flat steel plate to load a test specimen T, a hydraulic device 30 which presses the loading plate 20, a reaction force member 40 which supports reaction force attributable to pressing of the test specimen T by the hydraulic device 30, and a reaction force support 50. The test specimen T is cut out from a concrete structure such as a manhole. The upper surface of the test specimen T is provided with a top plate 20T of polystyrene foam. The lower surface of the test specimen T is provided with a bottom plate 20B of polystyrene foam. Herein, the upward direction refers to the direction from the floor F toward the reaction force member 40 in FIG. 5A. The downward direction refers to the direction from the reaction force member 40 to the floor F.

The structure tester 200 may be a large structure tester used to perform compressive strength testing for concrete under JIS A 1108. The hydraulic device 30 which applies a compressive load on the test specimen T may be configured to be capable of pressing the loading plate 20 with a prescribed load by driving a hydraulic cylinder. The hydraulic device 30 can be configured to adjust the flow rate or displacement rate by controlling a flow control valve which adjusts the flow rate to the hydraulic cylinder. Instead of the hydraulic device 30, a drive device using anything other than hydraulic pressure such as an electric motor may be configured to press the test specimen T.

Although a control circuit for controlling the structure tester 200 is not shown, the tester may include an input unit for receiving an operation input from the operator, a storage unit for storing test results, a display unit for displaying test results, and a control unit for controlling the operation of the entire structure tester 200. The control unit adjusts the pressurizing rate or displacement rate of the hydraulic device 30 for example by controlling the flow control valve described above. The control unit obtains an output from a strain gauge attached to the test specimen T. This allows the relation between the compression load value and the strain of the test specimen T to be obtained as data.

The loading plate 20 is a flat steel plate having a flat lower surface and transmits pressing force from the hydraulic device 30 to the test specimen T. As shown in FIGS. 5A and 5B, the loading plate 20 has a projected area slightly larger than the test specimen T in a plane view. The loading plate 20 can apply pressing force on the entire region of the upper surface of the test specimen T. It is preferable that the loading plate 20 has such a thickness that bending deformation of the loading plate 20 can be prevented even when the pressing force (compressive force) expected by the structure tester 200 is applied.

The top plate 20T is made of styrene foam (EPS: Expanded Poly-Styrene). Expanded polystyrene is a material obtained by foaming polystyrene into fine foams followed by curing, and the material is lightweight and elastic and has high impact absorption. The expanded polystyrene can deform as the size of the bubbles changes with respect to external force and can absorb the external force. Therefore, as shown in FIG. 5A, when the loading plate 20 is configured to press the test specimen T through the top plate 20T made of expanded polystyrene and the test specimen T is deformed by the load, the top plate 20T can deform in conformity with the deformed upper surface of the test specimen T and therefore can always be in contact with both the loading plate 20 and the upper surface of the test specimen T in a large area. Therefore, when the test specimen T is deformed, the loading plate 20 can press the entire region of the upper surface without localizing to the corner part of the upper surface of the test specimen T.

The bottom plate 20B is made of expanded polystyrene similarly to the top plate 20T. The bottom plate 20B made of expanded polystyrene is placed between the floor F and the test specimen T, so that even when the test specimen T is deformed because of the load for example from the loading plate 20, the bottom plate 20B is deformed in conformity with the deformation of the lower surface of the test specimen T, and the bottom plate 20B can always be in contact with both the lower surface of the test specimen T and the floor F in a large area. Therefore, the test specimen T can receive reaction force against the pressing force from the loading plate 20 at the entire surface of the test specimen T.

When the hydraulic device 30 presses the test specimen T downward, upward force acts on the reaction force member 40 which supports the hydraulic device 30 in response to reaction force from the floor F. This upward force is transmitted to the reaction force support 50 formed on each side of the reaction force member 40.

Now, a loading test using the structure tester 200 will be described.

First, two kinds of test specimens T were prepared. The test specimens T were each a resin concrete structure having a size of 3000×1405×1690 ($mm^3$) and a mass of 3.2 (t). One of the test specimens T was reinforced with the strip-shaped reinforcing member 18 and the reinforcing members 19. The test specimen T includes an upper slab 81 corresponding to the upper slab 11, a sidewall 82 corresponding to the sidewall 12, and a lower slab 83 corresponding to the lower slab 13. The strip-shaped reinforcing member 18 was provided only at the lower slab 83. The reinforcing members 19 were provided to fix the upper part of the sidewall 82 and the upper slab 81 and the lower part of the sidewall 82 and the lower slab 83 at the middle part of the sidewall 82 in the longitudinal direction A. The other test specimen T was not reinforced. A carbon fiber sheet made of carbon fiber was used for the strip-shaped reinforcing member 18.

Figure 6:
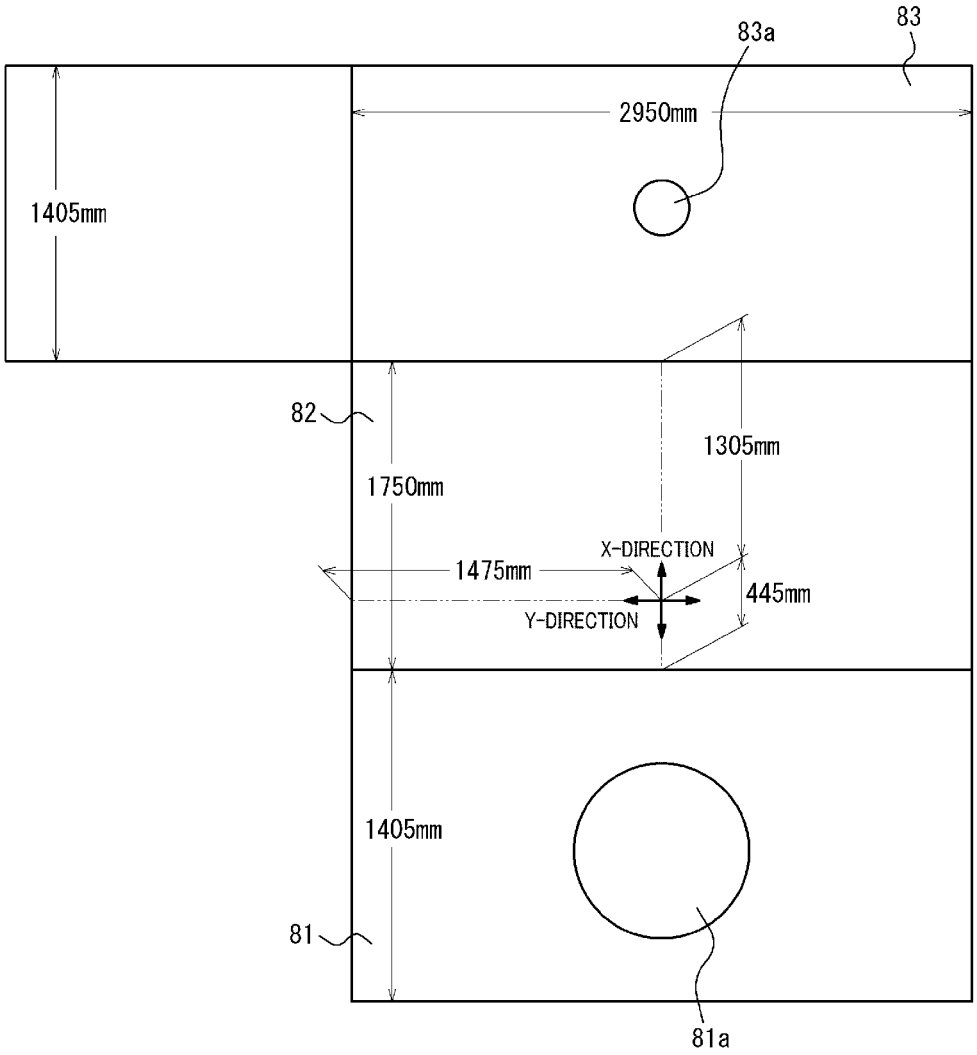
FIG. 6 is a partial net of a test specimen.

A strain gauge was attached to the test specimen T. FIG. 6 is a partially net of the test specimen T. In FIG. 6, the direction from one end of the sidewall 82 in contact with the upper slab 81 of the test specimen T toward the other end of the sidewall 82 in contact with the lower slab 83 (the height direction of the manhole) is set as the X-direction. The direction orthogonal to the X-direction along the surface of the sidewall 82 (the longitudinal direction of the manhole) is set as the Y-direction. The strain gauge was attached in a position 445 mm apart in the X direction from the end of the sidewall 82 in contact with the upper slab 81 (a position 1305 mm apart from the end of the sidewall 82 in contact with the lower slab 83) and 1475 mm apart from one end of the sidewall 82 in the longitudinal direction of the manhole in the Y-direction. The strain gauge detects the X- and Y-strain caused at the test specimens T. In FIG. 6, an opening 81*a* in communication with the internal space of the test specimen T is provided at the middle part of the upper slab 81, and a basin 83*a* having a cylindrical shape is provided at the lower slab 83.

Then, the test specimen T was installed at the structure tester 200. A 10 MN large structure tester manufactured by JFE Techno-Research Corporation was used as the structure tester 200. Styrene foam (DX-35 having a plate thickness of 100 mm from SEKISUI PLASTICS CO., Ltd.) was inserted between the floor F and the test specimen T and between the test specimen T and the loading plate 20. The loading plate 20 was then moved downward at a speed of 0.01 mm/sec to put a compressive load on the test specimen T by monotonic uniaxial loading.

Figure 7:
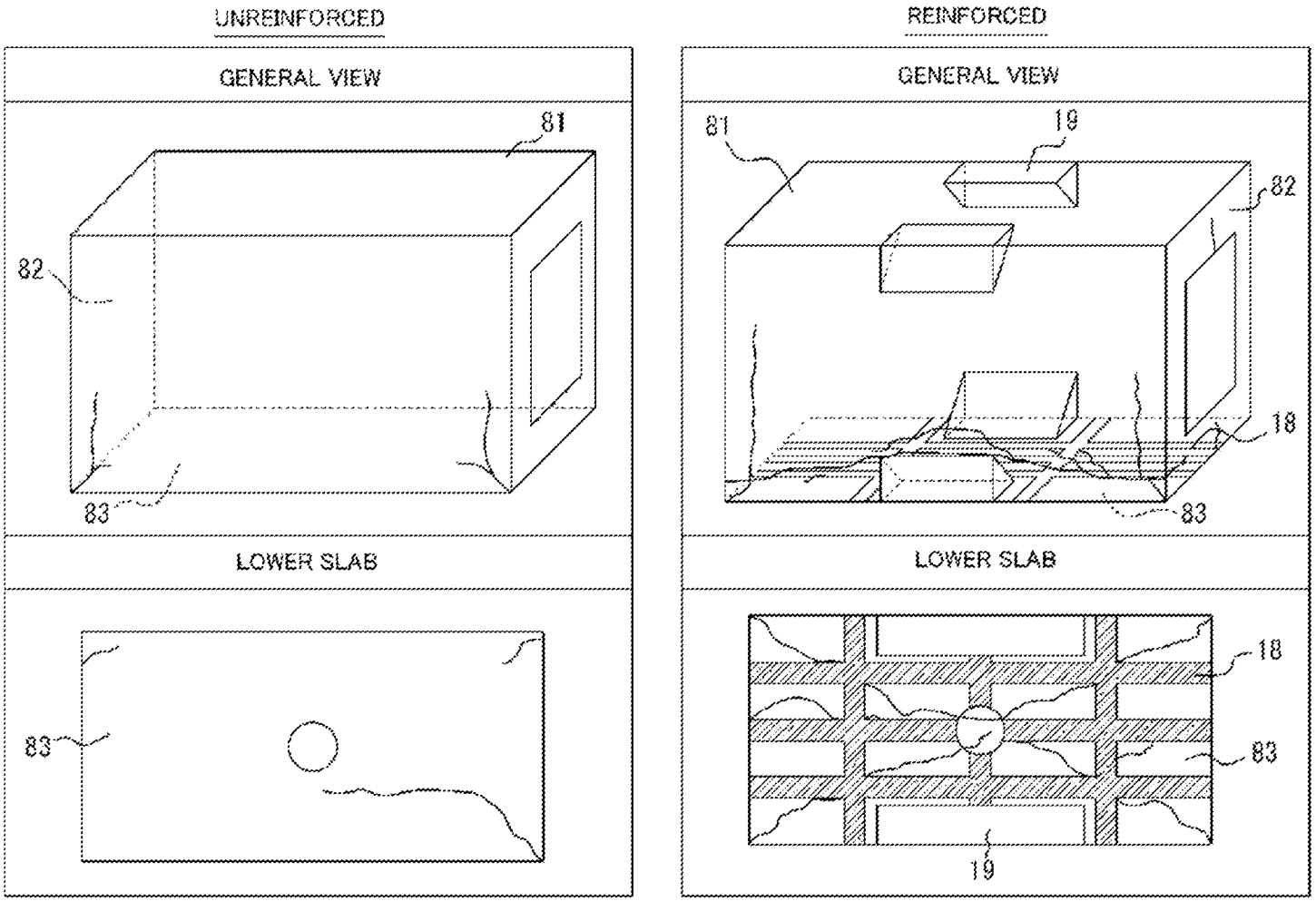
FIG. 7 shows an unreinforced test specimen and a reinforced test specimen each after a loading test and the state of cracks generated in the test specimens.

FIG. 7 shows the unreinforced test specimen T and the test specimen T reinforced with the strip-shaped reinforcing member 18 and the reinforcing members 19 (the reinforced test specimen T) each after a loading test and the state of cracks generated in the test specimens T. In FIG. 7, the state of cracks in the entire test specimen T (general view) and the lower slab 83 are shown for each of the unreinforced test specimen T and the reinforced test specimen T. Note that during the loading tests, a load greater than that of the unreinforced test specimen T was put on the reinforced test specimen T in order to cause further destruction. Therefore, as shown in FIG. 7, more cracks are observed in the reinforced test specimen T than in the unreinforced test specimen T.

As shown in FIG. 7, in the test specimens T after the loading tests, cracks were found in the lower slab 83 and the sidewall 82 regardless of whether the test specimen was reinforced or unreinforced.

As described above, in the reinforcing structure 100 according to the present embodiment, the strip-shaped reinforcing member 18 is not provided at the sidewall 12. In order to reduce cracks in the sidewall 12, it may be possible to provide the sidewall 12 with the strip-shaped reinforcing member 18 as in the conventional structure. However, it is probably unnecessary to provide the strip-shaped reinforcing member 18 at the sidewall 12 for the following reasons.

First, a resin manhole has a thinner wall thickness than that of a manhole of reinforced concrete, and since stress is generated from the inside to the outside against the sidewall 12, the strip-shaped reinforcing member 18 provided on the sidewall 12 if any does not function as a rigid body, and the reinforcement effect is small.

In the loading test described above, earth pressure from the outside to the inside to be applied on the manhole buried underground is not generated, and excessive stress is generated against the sidewall 82 corresponding to the sidewall 12. Therefore, the stress on the sidewall 12 generated underground is less than the value obtained in the loading test described above.

As a result of measurement by the inventors, it was determined on the basis of the displacement amount that the lower slab 83 corresponding to the lower slab 13 having the strip-shaped reinforcing member 18 is loaded with greater stress than the sidewall 82 corresponding to the sidewall 12 without the strip-shaped reinforcing member 18. Therefore, the reinforcement of the sidewall 12 probably has lower priority than further reinforcement of the lower slab 13.

Note that since the strip-shaped reinforcing member 18 provided at the lower slab 13 functions as a rigid body against the stress from the outside to the inside of the lower slab 13, higher strength can be probably obtained by providing the strip-shaped reinforcing member 18 at the lower slab 13 rather than providing the reinforcing member 19 alone.

Figure 8:
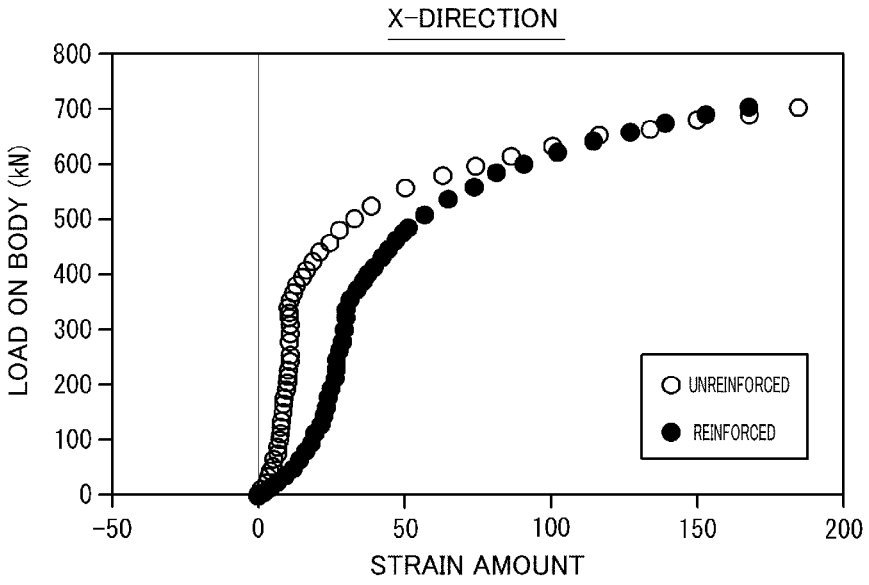
FIG. 8 show change in the amounts of strain generated in the X- and Y-directions at the lower parts of the sidewalls of the test specimens.
Figure 8:
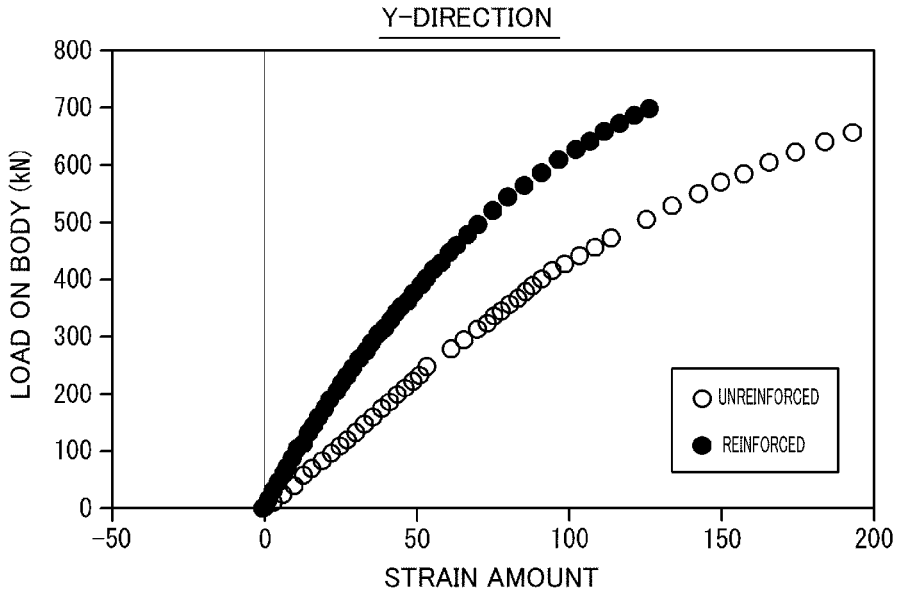

FIG. 8 shows change in strain amounts in the X- and Y-directions generated at the lower part of the sidewall 82 of the test specimen T (body). In FIG. 8, the ordinate represents the load (kN) on the body. The abscissa represents the amount of strain.

As shown in FIG. 8, in the X-direction, change in the strain amount is smaller for the unreinforced test specimen immediately after the body is loaded. It is probably because although the sidewall 82 protrudes from the inside to the outside immediately after loading, compressive force acts by the collapse of the entire body to keep the amount of strain less changed.

On the other hand, in the Y-direction, the strain amount is smaller for the reinforced specimen immediately after the loading. As opposed to the case in the X-direction, compressive force caused by the collapse of the body does not act, and therefore the amount of strain was probably smaller for the reinforced test specimen. The change in the strain of a member corresponds to external force that the member has been subjected to. Therefore, it has been experimentally determined that partial reinforcement of the corner part (reinforcement by the reinforcing members 19) can reduce external force from the inside to the outside caused by the load from the upper part of the body.

As described above, it can be understood that as the strip-shaped reinforcing members 18 are adhered to the lower slab 13, and the upper part of the sidewall 12 and the upper slab 11 and the lower part of the sidewall 12 and the lower slab 13 are fixed by the reinforcing members 19, so that external force acting from the inside to the outside resulting from the load from the upper part of the body can be reduced. When the sidewall 12 is not provided with the strip-shaped reinforcing members 18, the operation and material costs involved in the reinforcement can be reduced as compared to the case in which the strip-shaped reinforcing members 18 are provided at the sidewall 12.

Next, among the components of the reinforcing structure 100 for the manhole 1 according to the present embodiment, effects of reinforcement by the strip-shaped reinforcing members 18 provided at the upper slab 11 will be described.

As a result of intensive study, the inventors have found out that when the neck part 4 (see FIG. 1) is in a position shifted from the middle part of the upper slab 11 of the rectangular trunk part 2, the above reinforcement structure is not sufficient for the upper slab 11, and strain is locally concentrated at a location where the distance from the outer edge of the upper slab 11 to the opening 11*a* is long, so that cracks are generated in the upper slab 11.

In contrast, in the reinforcing structure 100 for the manhole 1 according to the present embodiment, the upper slab 11 is also provided with the strip-shaped reinforcing member 18 made of reinforced fiber. This can reduce the local concentration of strain in a location where the distance from the outer edge of the upper slab 11 to the opening 11*a* is long. As a result, cracks in the upper slab 11 can be prevented.

As described above, according to the present embodiment, the area of the strip-shaped reinforcing members 18 provided at the upper slab 11 is smaller than the area of the strip-shaped reinforcing members 18 provided at the lower slab 13. As described above, the strip-shaped reinforcing members 18 are not excessively provided at the upper slab 11, so that the operation and material costs involved in the reinforcement can be reduced as compared to the case in which the amount of the strip-shaped reinforcing members 18 provided at the upper slab 11 is equal to or more than that of the strip-shaped reinforcing member 18 provided at the lower slab 13.

Furthermore, as described above, the center position of the neck part 4 is provided in a shifted position to one end side (the left side in FIG. 3) with respect to the middle position of the trunk part 2 in the longitudinal direction A. Therefore, at the upper slab 11 of the trunk part 2 according to the present embodiment, the distance from the outer edge to the opening 11*a* is longer on the other end side (the right side in FIG. 3) in the longitudinal direction A with respect to the neck part 4 than on the end side mentioned above (the left side in FIG. 3). More specifically, at the upper slab 11 of the trunk part 2 according to the present embodiment, local strain is easily increased in the position on the other end side (the right side in FIG. 3) in the longitudinal direction A with respect to the neck part 4.

Therefore, according to the present embodiment, the area of the strip-shaped reinforcing members 18 provided at the upper slab 11 on the end side described above (the right side in FIG. 3) in the longitudinal direction A with respect to the neck part 4 is larger than the area of the members provided on the one end side (the left side in FIG. 3) in the longitudinal direction A with respect to the neck part 4. More specifically, according to the present embodiment, the strip-shaped reinforcing member 18 is not provided on the one end side (the left side in FIG. 3) in the longitudinal direction A with respect to the neck part 4, and the strip-shaped reinforcing member 18 is provided only on the other end side (the right side in FIG. 3) in the longitudinal direction A with respect to the neck part 4.

In this way, reinforcement can be efficiently provided in a position where the distance from the outer edge of the upper slab 11 to the opening 11*a* is long, in other words in a location where local strain is likely to occur. As a result, local strain can be prevented from increasing in a location where the distance from the outer edge of the upper slab 11 to the opening 11*a* is large, so that cracks can be reduced.

Also according to the present embodiment, the strip-shaped reinforcing members 18 at the upper slab 11 are provided in the transverse direction B. More specifically, the strip-shaped reinforcing members 18 at the upper slab 11 are provided entirely along the upper slab 11 in the transverse direction B. In this way, stress concentration from the outer edge of the upper slab 11 to the opening 11*a* can efficiently be relaxed.

Preferably, the strip-shaped reinforcing member 18 at the upper slab 11 is provided to cross the vicinity of the opening 11*a*. As shown in FIG. 3, the strip-shaped reinforcing member 18 may further be provided between the strip-shaped reinforcing member 18 provided near the opening 11*a* and the outer edge of the upper slab 11 on the other end side (the right side in FIG. 3) in the longitudinal direction A. When the distance between the strip-shaped reinforcing member 18 provided near the opening 11*a* and the outer edge of the upper slab 11 on the other end side (the right side in FIG. 3) in the longitudinal direction A is long, another strip-shaped reinforcing member 18 may be provided between these elements, as shown in FIG. 3 in order to reduce stress concentration at the intermediate position between these elements.

In order to determine the reinforcement effect of the reinforcing structure 100 according to the present embodiment, FEM (Finite Element Method) analysis was performed. In the FEM analysis, it was assumed that the material strength of the manhole 1 was lowered, and it was examined at which time point cracks were generated. For the FEM analysis, nonlinear structural analysis software "ATENA ver.5.1.1" manufactured by Research Center of Computational Mechanics, Inc. was used.

In the FEM analysis, two analysis models were produced for the manhole reinforcement structure. In the manholes in the two produced analysis models, the shape and reinforcement arrangement of the manholes were faithfully reproduced from the structural drawing and the reinforcement arrangement drawing. One of the analysis models was a reproduction of the reinforcing structure 100. The other analysis model was substantially equal to the above analysis model as a reproduction of the reinforcing structure 100 except that this model is removed of the strip-shaped reinforcing members 18 from the upper slab 11. Therefore, the difference between the two analysis models is only the presence or absence of the strip-shaped reinforcing member 18 provided at the upper slab 11. Hereinafter, for the sake of illustration, one of the analysis models reproduced as the reinforcing structure 100 will be referred to as "example model" and the other analysis model reproduced as the reinforcing structure 100 removed of the strip-shaped reinforcing member 18 at the upper slab 11 will be referred to as "comparative example model".

The mesh of the analysis model was a tetrahedral, one side of which is 10 cm and the mesh number was 26000. The following Table 1 and Table 2 show the parameters of the manholes and strip-shaped reinforcing members used in the two analysis models, respectively. The inner diameter of the opening 11*a* of the upper slab 11 is 0.850 m.

TABLE 1

| | |
|---|---|
| Earth covering thickness for manhole (d) | 0.410 m |
| Unit weight of material (γR) | 23.5 kN/m$^3$ |
| Material strength (σbk) | 18.0 MPa |
| Allowable unit stress bending tensile unit stress (σba) | 6.00 MPa |

TABLE 2

| | |
|---|---|
| Thickness | 1.0 mm |
| Width | 100 mm |
| Tensile proof stress | 120 kN |
| Young's modulus | 1.67 × 10$^5$ N/mm$^2$ |
| Tensile strength | 2400 N/mm$^2$ |

The following Table 3 shows design load parameters used in the FEM analysis.

TABLE 3

| Live loads | Automobile load | | 25 t |
|---|---|---|---|
| Static loads | Unit weight of relaid soil | <ground water level (γs1) | 15.69 kN/m$^3$ |
| | | ≥ground water level (γs2) | 19.61 kN/m$^3$ |
| | Earth pressure coefficient for relaid soil (KA) | | 0.333 |
| | Ground water level (HWL) | | GL-0.410 m |

Figure 9:
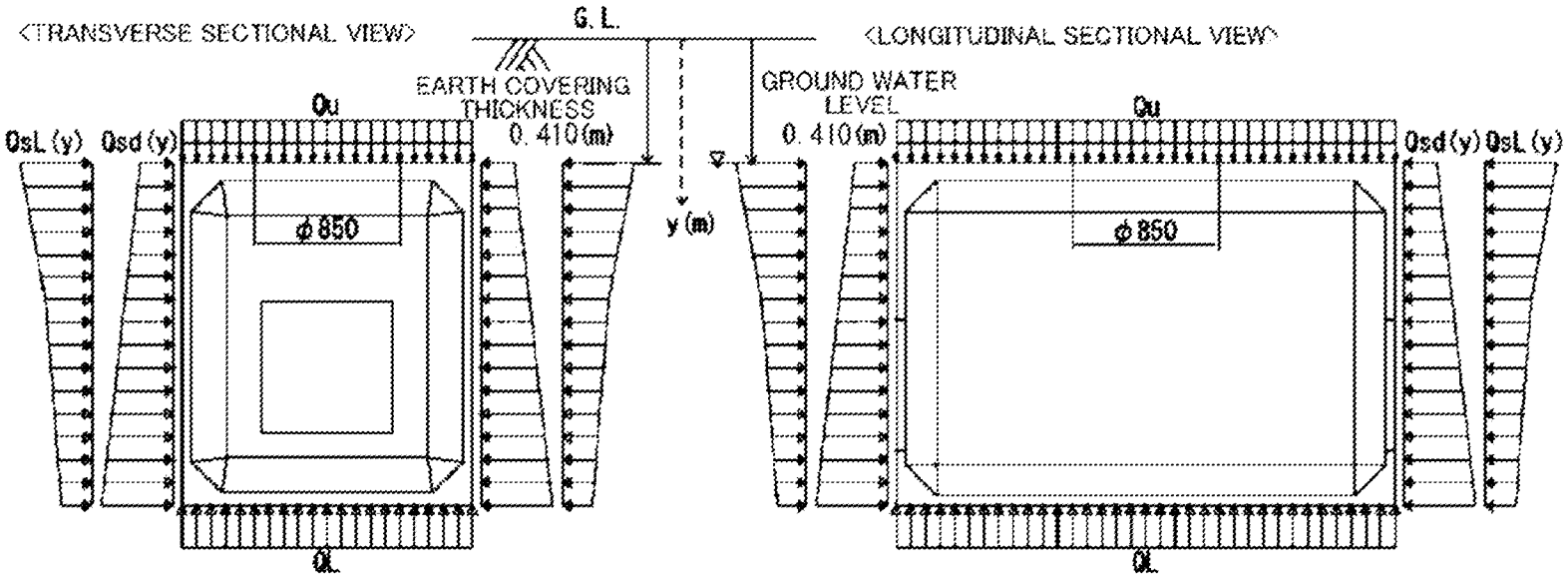
FIG. 9 is a view showing the state of earth pressure loading used in FEM analysis.

FIG. 9 is a view showing the state of earth pressure loading used in FEM analysis. The vertical earth pressure of relaid soil and the dead weight of the upper slab 11 act on the slab as a static load, and a road surface load applied by the rear wheels of a 25-ton truck as the truck passes thereon, i.e. a road surface load assumed for the manhole cover "T-25" specified by Japan Sewage Works Association Standards (JSWAS G-4) (see NPL 2) acts as a live load.

A lateral soil pressure "QsL" by the live load and a static soil pressure "Qsd" by the relaid soil (the weight of the soil) were assumed to be applied on the outer surface of the sidewall 12, and these pressures were assumed to vary in the depth-wise direction of the soil as shown in the loading states in FIG. 9.

The upper load (the live load and the static load) on the upper slab 11, the weight of cables to be accommodated, and the dead weight of the manhole excluding the weight of the lower slab 13 were assumed to act uniformly/equally on the lower slab 13 as a uniformly distributed load (subgrade reaction).

Figure 10:
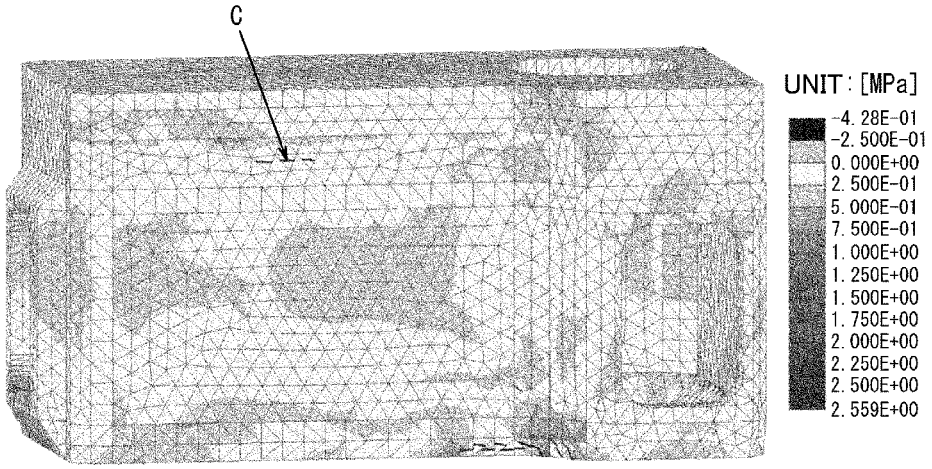
FIG. 10 shows an analysis result for an example model.
Figure 11:
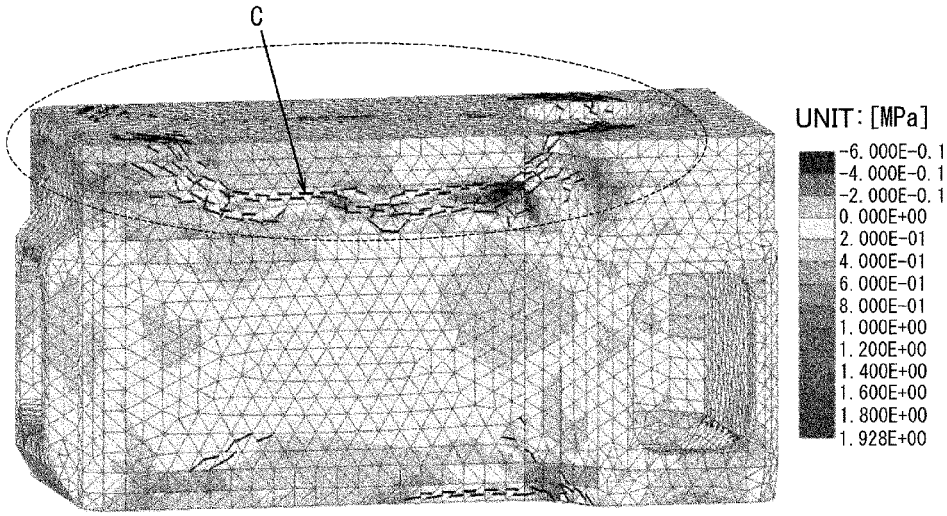
FIG. 11 shows an analysis result for a comparative example model.

FIGS. 10 and 11 show results of the FEM analysis. Specifically, FIG. 10 shows an analysis result of the example model as a reproduction of the reinforcing structure 100. FIG. 11 shows an analysis result of the comparative example model obtained by removing the strip-shaped reinforcing member 18 at the upper slab 11 from the reinforcing structure 100. FIGS. 10 and 11 show FEM analysis results when the material strength shown in Table 1 was lowered to 3.0 MPa.

As can be seen from FIG. 11, in the comparative example model, cracks C are generated in a wide area (within the broken line circle in FIG. 11) above the upper slab 11 and the sidewall 12. On the other hand, as can be seen from FIG. 10, there is almost no crack C in the example model. This is probably because local strain generation was suppressed by attaching the reinforced fiber strip-shaped reinforcing member 18 for example of fiber reinforced plastic to the upper slab 11. In particular, the strip-shaped reinforcing member 18 attached near the opening 11*a* made it difficult to cause strain around the opening 11*a*, so that the generation of cracks C were probably more effectively suppressed near the opening 11*a* of the upper slab 11 and at the upper part of the sidewall 12 where cracks C were generated in the comparative example model shown in FIG. 11.

As in the foregoing, the reinforcing structure 100 for the manhole 1 according to the present embodiment can reduce the cracks C at the upper slab 11 when the neck part 4 (see FIG. 1) is provided in a shifted position from the middle part of the upper slab 11 of the rectangular trunk part 2.

The manhole reinforcing method and the reinforcing structure according to the present invention are not limited to the specific method and structure illustrated in the above description of the present embodiment, and various modifications, substitutions, and variations may be made without departing from the scope of claims.

INDUSTRIAL APPLICABILITY

The present invention relates to a reinforcing method and a reinforcing structure for a manhole.

REFERENCE SIGNS LIST

1 Manhole
2 Trunk part
3 Protrusion
4 Neck part
11 Upper slab
11*a* Opening
12 Sidewall
12*a* Opening
12*b*, 12*c* Longitudinal sidewall
12*d*, 12*e* Transverse sidewall
13 Lower slab
13*a* Basin
14 Protrusion upper slab
15 Protrusion sidewall
15*a* Opening
16 Protrusion lower slab
17 Corner part
17*a* Slope part
18 Strip-shaped reinforcing member
19 Reinforcing member
20 Loading plate
20B Bottom plate
20T Top plate
30 Hydraulic device
40 Reaction force member
50 Reaction force support
81 Upper slab
81*a* Opening
82 Sidewall
83 Lower slab
83*a* Basin
100 Reinforcing structure
200 Structure tester
A Longitudinal direction of trunk part
B Transverse direction (in-plane direction of upper slab and orthogonal to longitudinal direction of trunk part)
C Crack
F Floor
T Test specimen

The invention claimed is:

1. A reinforcement member of a structure buried underground for reinforcing the structure, the reinforcement member comprising:

a rectangular trunk, wherein the rectangular trunk includes an upper slab, a sidewall, and a lower slab, wherein the upper slab and the lower slab except the side wall include a plurality of strip-shaped reinforcing members using a reinforced fiber, wherein a first set of reinforcing members fixes an upper part of the sidewall and the upper slab in a middle part of the sidewall in a longitudinal direction of the rectangular trunk, and wherein a second set of the reinforcing members fixes a lower part of the sidewall and the lower slab in the middle part of the sidewall in the longitudinal direction of the rectangular trunk; and a neck, wherein the neck is in a position shifted from a middle part of the upper slab of the rectangular trunk.

2. The reinforcement member of claim 1, wherein a first area occupied by the first set of the strip-shaped reinforcing members on the upper slab is smaller than a second area occupied by the second set of the strip-shaped reinforcing member on the lower slab.

3. The reinforcement member of claim 1, wherein the neck has a center position shifted toward one of end sides from a middle position of the rectangular trunk in the longitudinal direction, and wherein a first area occupied by the first set of the strip-shaped reinforcing members on the upper slab on the other of the end sides from the middle section of the rectangular trunk is greater than a second area occupied by the first set of the strip-shaped reinforcing members on the one side of the end sides.

4. The reinforcement member of claim 1, wherein the first set of the strip-shaped reinforcing members is in an in-plane direction of the upper slab and in a direction orthogonal to the longitudinal direction of the rectangular trunk.

5. The reinforcement member of claim 2, wherein the first set of the strip-shaped reinforcing members is in an in-plane direction of the upper slab and in a direction orthogonal to the longitudinal direction of the rectangular trunk.

6. The reinforcement member of claim 3, wherein the first set of the strip-shaped reinforcing members is in an in-plane direction of the upper slab and in a direction orthogonal to the longitudinal direction of the rectangular trunk.

7. The reinforcement member of claim 2, wherein the structure is based at least on a resin material, and wherein the second set of the strip-shaped reinforcing members on the lower slab provides as a body against a stress from the outside to the inside of the lower slab.

8. A method for reinforcing a structure buried underground, the method comprising:

fixing, using a first set of reinforcing members, an upper part of a sidewall and a upper slab in a middle part of the sidewall in a longitudinal direction of a rectangular trunk, wherein the structure includes the rectangular trunk and a neck, the rectangular trunk includes the upper slab, the side wall, and the lower slab, and the neck is in a position shifted from a middle part of the upper slab of the rectangular trunk;

fixing, using a second set of the reinforcing members, a lower part of the sidewall and the lower slab in the middle part of the sidewall in the longitudinal direction of the rectangular trunk; and placing strip-shaped reinforcing members using reinforced fiber on the upper slab and the lower slab except the side wall.

9. The method of claim 8, wherein a first area occupied by the first set of the strip-shaped reinforcing members on the upper slab is smaller than a second area occupied by the second set of the strip-shaped reinforcing member on the lower slab.

10. The method of claim 8, wherein the neck has a center position shifted toward one of end sides from a middle position of the rectangular trunk in the longitudinal direction, and wherein a first area occupied by the first set of the strip-shaped reinforcing members on the upper slab on the other of the end sides from the middle section of the rectangular trunk is greater than a second area occupied by the first set of the strip-shaped reinforcing members on the one side of the end sides.

11. The method of claim 8, wherein the first set of the strip-shaped reinforcing members is in an in-plane direction of the upper slab and in a direction orthogonal to the longitudinal direction of the rectangular trunk.

12. The method of claim 9, wherein the first set of the strip-shaped reinforcing members is in an in-plane direction of the upper slab and in a direction orthogonal to the longitudinal direction of the rectangular trunk.

13. The method of claim 10, wherein the first set of the strip-shaped reinforcing members is in an in-plane direction of the upper slab and in a direction orthogonal to the longitudinal direction of the rectangular trunk.

14. The method of claim 9, wherein the structure is based at least on a resin material, and wherein the second set of the strip-shaped reinforcing members on the lower slab provides as a body against a stress from the outside to the inside of the lower slab.

15. A system of a reinforced structure buried underground, the system comprising:

a rectangular trunk, wherein the rectangular trunk includes an upper slab, a sidewall, and a lower slab, wherein the upper slab and the lower slab except the side wall include a plurality of strip-shaped reinforcing members using a reinforced fiber, wherein a first set of reinforcing members fixes an upper part of the sidewall and the upper slab in a middle part of the sidewall in a longitudinal direction of the rectangular trunk, and wherein a second set of the reinforcing members fixes a lower part of the sidewall and the lower slab in the middle part of the sidewall in the longitudinal direction of the rectangular trunk; and a neck, wherein the neck is in a position shifted from a middle part of the upper slab of the rectangular trunk.

16. The system of claim 15, wherein a first area occupied by the first set of the strip-shaped reinforcing members on the upper slab is smaller than a second area occupied by the second set of the strip-shaped reinforcing member on the lower slab.

17. The system of claim 15, wherein the neck has a center position shifted toward one of end sides from a middle position of the rectangular trunk in the longitudinal direction, and wherein a first area occupied by the first set of the strip-shaped reinforcing members on the upper slab on the other of the end sides from the middle section of the rectangular trunk is greater than a second area occupied by the first set of the strip-shaped reinforcing members on the one side of the end sides.

18. The system of claim 15, wherein the first set of the strip-shaped reinforcing members is in the in-plane direction of the upper slab and in a direction orthogonal to the longitudinal direction of the rectangular trunk.

19. The system of claim 16, wherein the first set of the strip-shaped reinforcing members is in the in-plane direction of the upper slab and in a direction orthogonal to the longitudinal direction of the rectangular trunk.

20. The system of claim 17, wherein the first set of the strip-shaped reinforcing members is in the in-plane direction of the upper slab and in a direction orthogonal to the longitudinal direction of the rectangular trunk.

* * * * *